US005238555A

United States Patent [19]

Pappas et al.

[11] Patent Number: 5,238,555

[45] Date of Patent: Aug. 24, 1993

[54] PROCESS FOR PURIFYING A HYDROGEN GAS AND RECOVERING LIQUIFIABLE HYDROCARBONS FROM HYDROCARBONACEOUS EFFLUENT STREAMS

[75] Inventors: Scott W. Pappas, Crystal Lake; Donald E. Felch, Arlington Heights, both of Ill.

[73] Assignee: UOP, Des Plaines, Ill.

[21] Appl. No.: 799,593

[22] Filed: Nov. 27, 1991

[51] Int. Cl.[5] ..... C10G 5/00

[52] U.S. Cl. ..... 208/340; 208/100; 208/101; 208/133; 208/134

[58] Field of Search ..... 208/100, 101, 133, 134, 208/340

[56] References Cited

U.S. PATENT DOCUMENTS

| | | | |
|---|---|---|---|
| 3,431,195 | 3/1969 | Storch et al. | 208/101 |
| 3,516,924 | 6/1970 | Forbes | 208/65 |
| 3,520,799 | 7/1970 | Forbes | 208/101 |
| 3,520,800 | 7/1970 | Forbes | 208/101 |
| 3,882,014 | 5/1975 | Monday et al. | 208/134 |
| 4,212,726 | 7/1980 | Mayes | 208/101 |
| 4,333,819 | 6/1982 | Scheifele | 208/101 |
| 4,364,820 | 12/1982 | DeGraff et al. | 208/101 |
| 4,374,726 | 2/1983 | Schmelzer et al. | 208/101 |
| 4,568,451 | 2/1986 | Greenwood et al. | 208/340 |

OTHER PUBLICATIONS

Nov. 10, 1989 issue of the Oil and Gas Journal, pp. 191-197, "Catalytic LPG Dehydrogenation Fits in 80's Outlook" by R. C. Berg. J. R. Mowry & B. V. Vora.

*Primary Examiner*—Theodore Morris
*Assistant Examiner*—Walter D. Griffin
*Attorney, Agent, or Firm*—Thomas K. McBride; John G. Tolomei

[57] ABSTRACT

A process for recovering hydrogen-rich gases and increasing the recovery of liquid hydrocarbon products from a hydrocarbon conversion zone effluent is improved by a particular arrangement of two refrigeration zones and an absorption vessel.

2 Claims, 2 Drawing Sheets

PROCESS FOR PURIFYING A HYDROGEN GAS AND RECOVERING LIQUIFIABLE HYDROCARBONS FROM HYDROCARBONACEOUS EFFLUENT STREAMS

BACKGROUND OF THE INVENTION

1. Field of the Invention

The present invention is related to methods for recovering a hydrogen-rich gas stream from a hydrogen and hydrocarbon effluent of a catalytic hydrocarbon conversion zone. In addition this invention improves the recovery of liquifiable hydrocarbons from hydrogen and hydrocarbon effluent streams.

Various types of catalytic hydrocarbon conversion reaction systems have found widespread utilization throughout the petroleum and petrochemical industries for effecting the conversion of hydrocarbons to different products. The reactions employed in such systems are either exothermic or endothermic, and of more importance to the present invention, often result in either the net production of hydrogen or the net consumption of hydrogen. Such reaction systems, as applied to petroleum refining, have been employed to effect numerous hydrocarbon conversion reactions including those which predominate in catalytic reforming, ethylbenzene dehydrogenation to styrene, propane and butane dehydrogenation, etc.

Petroleum refineries and petrochemical complexes customarily comprise numerous reaction systems. Some systems within the refinery or petrochemical complex may result in the net production of hydrogen. Because hydrogen is relatively expensive, it has become the practice within the art of hydrocarbon conversion to supply hydrogen from reaction systems which result in the net production of hydrogen to reaction systems which are net consumers of hydrogen. Occasionally, the net hydrogen being passed to the net hydrogen-consuming reactions systems must be of high purity due to the reaction conditions and/or the catalyst employed in the systems. Such a situation may require treatment of the hydrogen from the net hydrogen-producing reaction systems to remove hydrogen sulfide, light hydrocarbons, etc. from the net hydrogen stream.

Alternatively, the hydrogen balance for the petroleum refinery or petrochemical complex may result in excess hydrogen, i.e., the net hydrogen-producing reaction systems produce more hydrogen than is necessary for the net hydrogen-consuming reaction systems. In such an event, the excess hydrogen may be sent to the petroleum refinery or petrochemical complex fuel system. However, because the excess hydrogen often has admixed therewith valuable components, such as $C_3+$ hydrocarbons, it is frequently desirable to treat the excess hydrogen to recover these components prior to its passage to fuel.

Typical of the net hydrogen-producing hydrocarbon reaction systems are catalytic reforming, catalytic dehydrogenation of alkylaromatics and catalytic dehydrogenation of paraffins. Commonly employed net hydrogen-consuming reaction systems are hydrotreating, hydrocracking and catalytic hydrogenation. Of the above-mentioned net hydrogen-producing and consuming hydrocarbon reaction systems, catalytic reforming ranks as one of the most widely employed. By virtue of its wide application and its utilization as a primary source of hydrogen for the net hydrogen-consuming reactions systems, catalytic reforming has become well known in the art of hydrocarbon conversion reaction systems.

It is well known that high quality petroleum products in the gasoline boiling range including, for example, aromatic hydrocarbons such as benzene, toluene and the xylenes, are produced by the catalytic reforming process wherein a naphtha fraction is passed to a reaction zone wherein it is contacted with a platinum-containing catalyst in the presence of hydrogen. Generally, the catalytic reforming reaction zone effluent, comprising gasoline boiling range hydrocarbons and hydrogen, is passed to a vapor-liquid equilibrium separation zone and is therein separated into a hydrogen-containing vapor phase and an unstabilized hydrocarbon liquid phase. A portion of the hydrogen-containing vapor phase may be recycled to the reaction zone. The remaining hydrogen-containing vapor phase is available for use either by the net hydrogen-consuming processes or as fuel for the petroleum refinery or petrochemical complex fuel system. While a considerable portion of the hydrogen-containing vapor phase is required for recycle purposes, a substantial net excess is available for the other uses.

Because the dehydrogenation of naphthenic hydrocarbons is one of the predominant reactions of the reforming process, substantial amounts of hydrogen are generated within the catalytic reforming reaction zone. Accordingly, a net excess of hydrogen is available for use as fuel or for use in a net hydrogen-consuming process such as the hydrotreating of sulfur-containing petroleum feedstocks. However, catalytic reforming also involves a hydrocracking function among the products of which are relatively low molecular weight hydrocarbons including methane, ethane, propane, butanes and the pentanes, substantial amounts of which appear in the hydrogen-containing vapor phase separated from the reforming reaction zone effluent. These normally gaseous hydrocarbons have the effect of lowering the hydrogen purity of the hydrogen-containing vapor phase to the extent that purification is often required before the hydrogen is suitable for other uses. Moreover, if the net excess hydrogen is intended for use as fuel in the refinery or petrochemical complex fuel system, it is frequently desirable to maximize the recovery of $C_3+$ hydrocarbons which are valuable as feedstock for other processes.

Many processes for the purification of hydrogen-rich gas streams from the effluent of hydrocarbon conversion reaction zones are disclosed. U.S. Pat. No. 3,431,195, issued Mar. 4, 1969, discloses a process wherein the hydrogen and hydrocarbon effluent of a catalytic reforming zone is first passed to a low pressure vapor-liquid equilibrium separation zone from which zone is derived a first hydrogen-containing vapor phase and a first unstabilized hydrocarbon liquid phase. The hydrogen-containing vapor phase is compressed and recontacted with at least a portion of the liquid phase and the resulting mixture is passed to a second high pressure vapor-liquid equilibrium separation zone. Because the second zone is maintained at a higher pressure, a new vapor liquid equilibrium is established resulting in a hydrogen-rich gas phase and a second unstabilized hydrocarbon liquid phase. A portion of the hydrogen-rich vapor phase is recycled back to the catalytic reforming reaction zone with the balance of the hydrogen-rich vapor phase being recovered as a hydrogen-rich gas stream relatively free of $C_3$–$C_6$ hydrocarbons.

U.S. Pat. No. 3,516,924, issued Jun. 23, 1970, discloses a system wherein the reaction zone effluent from a catalytic reforming process is first separated in a vapor-liquid equilibrium separation zone to produce a hydrogen-containing vapor phase and an unstabilized liquid hydrocarbon phase. The two phases are again recontacted and again separated in a higher pressure vapor-liquid equilibrium separation zone. A first portion of the resulting hydrogen-rich vapor phase is recycled back to the catalytic reforming zone while the remaining portion of the hydrogen-rich vapor phase is passed to an absorber column in which stabilized reformate is utilized as the sponge oil. A high purity hydrogen gas stream is recovered from the absorption zone and the sponge oil, containing light hydrocarbons, is recontacted with the hydrocarbon liquid phase from the first vapor-liquid equilibrium separation zone prior to the passage thereof to the second high pressure vapor-liquid equilibrium separation zone.

U.S. Pat. No. 3,520,800, issued Jul. 14, 1970, discloses a method of obtaining a hydrogen-rich gas stream from a catalytic reforming reaction zone effluent. As in the previously discussed methods, the reforming reaction zone effluent is passed to a first vapor-liquid equilibrium separation zone from which is obtained a first hydrogen-containing vapor phase and a first unstabilized hydrocarbon liquid phase. The hydrogen-containing vapor phase is compressed and recontacted with the hydrocarbon liquid phase. Thereafter the mixture is passed to a second vapor-liquid equilibrium separation zone maintained at a higher pressure than the first vapor-liquid equilibrium separation zone. A second hydrogen-containing vapor phase of higher hydrogen purity is recovered from the second vapor-liquid equilibrium separation zone with a portion thereof being recycled back to the catalytic reforming reaction zone. The remaining amount of the resulting hydrogen-containing vapor phase is passed to a cooler wherein the temperature of the phase is reduced at least 20° F. lower than the temperature maintained in the second vapor-liquid equilibrium separation zone. After cooling, the hydrogen phase is passed to a third vapor-liquid equilibrium separation zone from which a high purity hydrogen gas stream is recovered.

U.S. Pat. No. 3,520,799, issued Jul. 14, 1970, discloses yet another method for obtaining a high purity hydrogen gas stream from a catalytic reforming reaction zone effluent. As in all the previous schemes, the reaction zone effluent is passed to a low pressure vapor-liquid equilibrium separation zone from which is produced a hydrogen-containing vapor phase and an unstabilized liquid hydrocarbon phase. After compression, the hydrogen-containing vapor phase is recontacted with the unstabilized liquid hydrocarbon phase and the resulting mixture is passed to a high pressure vapor-liquid equilibrium separation zone. A second hydrogen-containing vapor phase is produced of higher purity than the hydrogen-containing vapor phase from the low pressure vapor-liquid equilibrium separation zone. A first portion of this higher purity hydrogen-containing vapor phase is recycled back to the catalytic reforming zone. The balance of the higher purity hydrogen-containing vapor phase is passed to an absorption zone where it is contacted with a lean sponge oil preferably comprising $C_6$+hydrocarbons. A hydrogen-containing gas stream is removed from the absorber and after cooling, passed to a third vapor-liquid equilibrium separation zone. The sponge oil, containing constituents absorbed from the higher purity hydrogen-containing vapor phase is removed from the absorption zone and is admixed with the unstabilized liquid hydrocarbon stream from the low pressure vapor-liquid equilibrium separation zone prior to the recontacting thereof with the compressed hydrogen-containing vapor phase. A stream of high purity hydrogen gas is removed from the third vapor-liquid equilibrium separation zone.

U.S. Pat. No. 3,882,014, insured May 6, 1975, discloses another method of obtaining a high purity hydrogen stream from the reaction zone effluent of a catalytic reforming process. The catalytic reforming reaction zone effluent is first passed to a vapor-liquid equilibrium separation zone from which is recovered an unstabilized liquid hydrocarbon stream and a hydrogen-containing vapor phase. After compression, the hydrogen-containing vapor phase is passed to an absorption zone wherein it is contacted with a sponge oil comprising stabilized reformate. A high purity hydrogen gas stream is recovered from the absorption zone with one portion thereof being recycled back to the catalytic reforming reaction zone while the remainder is recovered for further use. A liquid stream is recovered from the absorption zone and admixed with the unstabilized liquid hydrocarbon stream from the vapor-liquid equilibrium separation zone. The admixture is then fractionated in a stabilizing column to produce the stabilized reformate, a first portion of which is utilized as the sponge oil in the absorption zone.

U.S. Pat. No. 4,212,726, issued Jul. 15, 1980, discloses a method for recovering high purity hydrogen streams from catalytic reforming reaction zone effluents wherein the reaction zone effluent from the catalytic reforming process is passed to a first vapor-liquid equilibrium separation zone from which is recovered a first unstabilized hydrocarbon stream and a first hydrogen-containing vapor stream. After compression, the hydrogen-containing vapor stream is passed to an absorption column wherein it is contacted with the first liquid hydrocarbon phase from the vapor-liquid equilibrium separation zone and stabilized reformate. A high purity hydrogen gas stream is recovered from the absorption zone with one portion being recycled back to the reaction zone and the balance being recovered for further use.

U.S. Pat. No. 4,364,820, issued Dec. 21, 1982, discloses a method of recovering high purity hydrogen gas from a catalytic reforming reaction zone effluent wherein the reaction zone effluent is first separated in a vapor-liquid equilibrium separation zone into a first hydrogen-containing vapor phase and a first liquid hydrocarbon phase. One portion of the first hydrogen-containing vapor phase is compressed and recycled back to the catalytic reaction zone. The balance of the hydrogen-containing vapor phase is compressed and contacted with a second liquid hydrocarbon phase recovered from a hereinafter described third vapor-liquid equilibrium separation zone. The admixture is then passed to a second vapor-liquid equilibrium separation zone from which is derived a third liquid hydrocarbon phase comprising unstabilized reformate and a second hydrogen-containing vapor phase of higher purity than the first hydrogen-containing vapor phase derived from the first vapor-liquid equilibrium separation zone. The second hydrogen-containing vapor phase is subjected to compression and then contacted with the first liquid hydrocarbon phase from the first vapor-liquid equilibrium separation zone. The resulting admixture is then passed to a third vapor-liquid equilibrium separation zone from which is derived a hydrogen gas stream of high purity and the aforementioned second liquid hydrocarbon phase.

U.S. Pat. No. 4,374,726, issued Feb. 22, 1983, discloses a further method of obtaining a high purity hydrogen gas stream from the reaction zone effluent of a catalytic reforming process. In this reference, the reaction zone effluent is passed to a vapor-liquid equilibrium separation zone to produce a first hydrocarbon liquid phase and a hydrogen-containing vapor phase. A first portion of the hydrogen-containing vapor phase is compressed and recycled to the catalytic reforming reaction zone. A second portion of the hydrogen-containing vapor phase is compressed and thereafter recontacted with the first liquid hydrocarbon phase from the vapor-liquid equilibrium separation zone. The resulting admixture is then passed to a second vapor-liquid equilibrium separation zone to produce a hydrogen gas stream of high purity and a second liquid hydrocarbon phase comprising unstabilized reformate.

U.S. Pat. No. 4,568,451, issued Feb. 4, 1986 discloses a method of recovering high purity hydrogen gas from a catalytic reforming reaction zone effluent wherein the reaction zone effluent is first separated in a vapor-liquid equilibrium separation zone into a first hydrogen-containing vapor phase and a first unstabilized liquid hydrocarbon phase. One portion of the first hydrogen-containing vapor phase is compressed and recycled back to the catalytic reaction zone. The balance of the hydrogen-rich vapor phase is admixed with a portion of the first unstabilized liquid reformate chilled and passed to an equilibrium separator from which a hydrogen-rich vapor phase and a second liquid hydrocarbon phase comprising unstabilized reformate are recovered.

In addition to the above-mentioned patent literature, the technical literature within the art has also disclosed methods for separating reaction zone effluents to obtain hydrogen-containing gas streams. For example, the Nov. 10, 1980 issue of the *Oil and Gas Journal* discloses an LPG dehydrogenation process in which the entire reaction zone effluent is first dried, then subjected to indirect heat exchange with a cool hydrogen-containing gas stream. The cool hydrogen-containing gas stream is derived by passing the entire cooled reaction zone effluent to a vapor-liquid equilibrium separation zone. The hydrogen-containing gas stream is removed from the separation zone and is then expanded. Thereafter it is subjected to indirect heat exchange with the entire reaction zone effluent. After the indirect heat exchange step, a portion of the hydrogen-containing vapor phase is recycled to the reaction zone.

The many art references have shown many similar arrangements of chillers, separators, absorbers, compressors, and heat exchange equipment for recovering a hydrogen-rich gas stream and liquifiable hydrocarbon components from a hydrocarbonaceous effluent of a catalytic conversion zone. Out of the many combinations of such components that can be used, it has been discovered that a particular arrangement of separators and refrigeration equipment will dramatically improve the recovery of liquifiable hydrocarbons in such a system with only a relatively simple arrangement of components.

SUMMARY OF THE INVENTION

It has been discovered that by the precooling and chilling of vapor and liquid streams and the subsequent countercurrent contacting of the chilled vapor and liquid streams in an absorption zone significant additional recoveries of $C_4$ and, in particular, $C_3$ hydrocarbons can be obtained.

Accordingly, in one embodiment, this invention is a process for producing a hydrogen-rich gas stream by treating a hydrogen and hydrocarbon effluent from a catalytic hydrocarbon conversion reaction zone. In the process, at least a portion of the effluent is passed to a vapor-liquid separation zone and split into a hydrogen-containing vapor phase and a first liquid phase comprising hydrocarbons. At least a portion of the hydrogen-containing vapor phase is cooled by indirect heat exchange with a first hydrogen-rich gas stream and refrigerated. A portion of the first liquid phase comprising 20 to 75 vol. % of the total first liquid phase is cooled by indirect heat exchange with a second liquid phase and refrigerated. The refrigerated hydrogen containing vapor phase and the refrigerated first liquid phase are passed to an absorption zone and countercurrently contacted therein to absorb hydrocarbons from the vapor phase. The second liquid phase is withdrawn from the absorption zone and recovered after heat exchange with the first liquid phase and the hydrogen-gas stream is withdrawn from the absorption zone and recovered after heat exchange with the hydrogen containing gas stream.

DETAILED DESCRIPTION OF THE INVENTION

Figure 1:
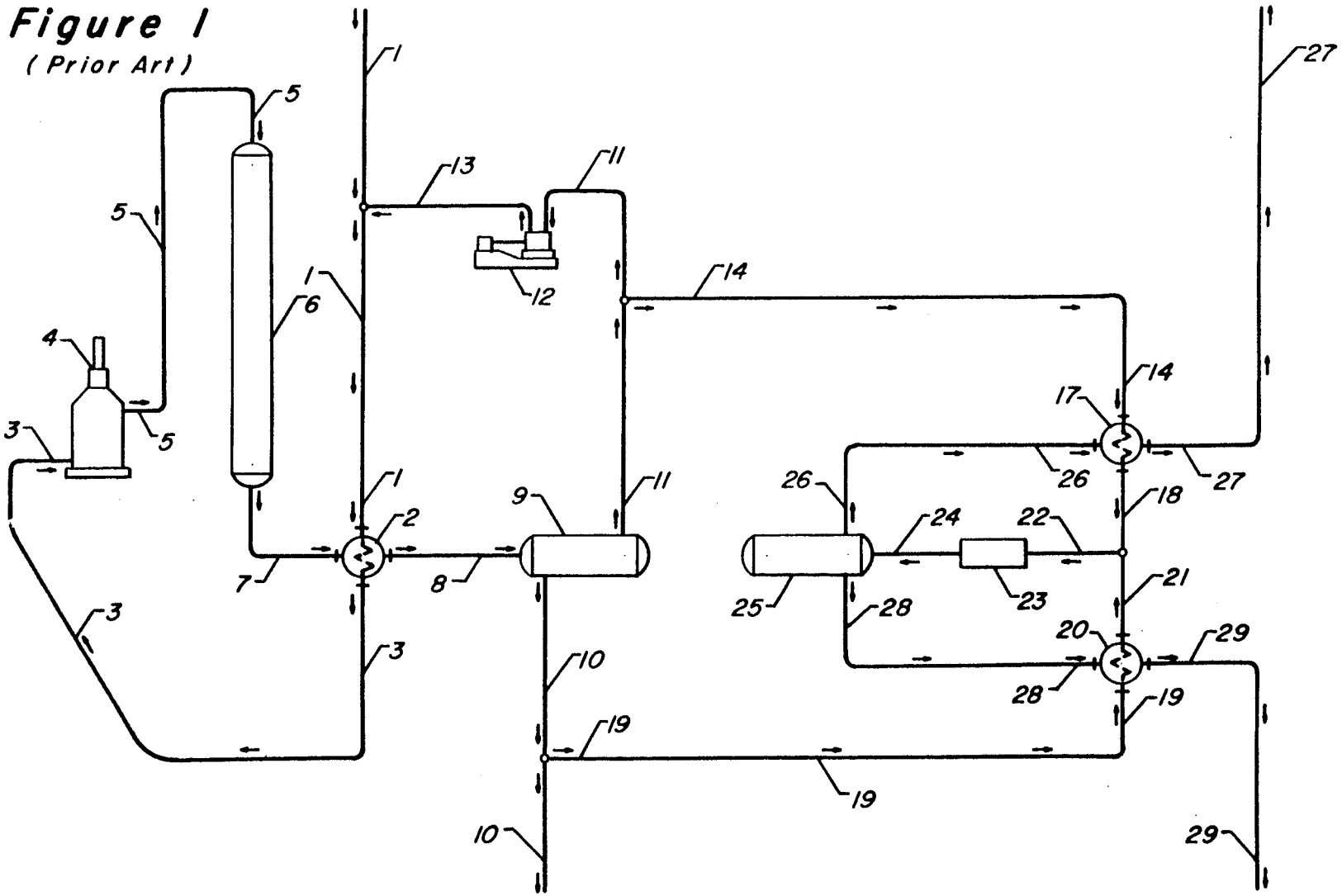
Figure 1 (Prior Art)
FIG. 1 illustrates a reforming process and a prior art separation arrangement for recovering a hydrogen-rich product and a liquid reformate.

The process of this invention is suitable for use in hydrocarbon conversion reaction systems which may be characterized as single or multiple reaction zones in which catalyst particles are disposed as fixed beds or movable via gravity flow. Moreover, the present invention may be advantageously utilized in hydrocarbon conversion reaction systems which result in the net production or the net consumption of hydrogen. Although the following discussion is specifically directed toward catalytic reforming of naphtha boiling range fractions, there is no intent to so limit the present invention.

The art of catalytic reforming is well known to the petroleum refining and petrochemical processing industry. Accordingly, a detailed description thereof is not required herein. In brief, the catalytic reforming art is largely concerned with the treatment of a petroleum gasoline fraction to improve its anti-knock characteristics. The petroleum fraction may be a full boiling range gasoline fraction having an initial boiling point of from about 50° to about 100° F. and an end boiling point from about 325° to about 425° F. More frequently the gasoline fraction will have an initial boiling point of about 150° to about 250° F. and an end boiling point of from about 350° to 425° F., this higher boiling fraction being commonly referred to as naphtha. The reforming process is particularly applicable to the treatment of those straight-run gasolines comprising relatively large concentrations of naphthenic and substantially straight-chain paraffinic hydrocarbons which are amenable to aromatization through dehydrogenation and/or cyclization. Various other concomitant reactions also occur, such as isomerization and hydrogen transfer, which are beneficial in upgrading the anti-knock properties of the selected gasoline fraction. In addition to improving the anti-knock characteristics of the gasoline fraction, the tendency of the process to produce aromatics from naphthenic and paraffinic hydrocarbons makes catalytic reforming an invaluable source for the production of benzene, toluene, and xylenes which are all of great utility in the petrochemical industry.

Widely accepted catalysts for use in the reforming process typically comprise platinum on an alumina support. These catalysts will generally contain from about 0.05 to about 5 wt. % platinum. Certain promoters or modifiers, such as cobalt, nickel, rhenium, germanium and tin, have been incorporated into the reforming catalyst to enhance its performance.

The catalytic reforming of naphtha boiling range hydrocarbons, a vapor phase operation, is effected at conversion conditions which include catalyst bed temperatures in the range of from about 700° to about 1020° F. Other conditions generally include a pressure of from about 20 to about 1000 psig, a liquid hourly space velocity (defined as volumes of fresh charge stock per hour per volume of catalyst particles in the reaction zone) of from about 0.2 to about 10 $hr.^{-1}$ and a hydrogen to hydrocarbon mole ratio generally in the range of from about 0.5:1 to about 10:1.

The catalytic reforming reaction is carried out at the aforementioned reforming conditions in a reaction zone comprising either a fixed or a moving catalyst bed. Usually, the reaction zone will comprise a plurality of catalyst beds, commonly referred to as stages, and the catalyst beds may be stacked and enclosed within a single reactor vessel, or the catalyst beds may each be enclosed in a separate reactor vessel in a side-by-side reactor arrangement. Generally, a reaction zone will comprise two to four catalyst beds in either the stacked and/or side-by-side configuration. The amount of catalyst used in each of the catalyst beds may be varied to compensate for the endothermic heat of reaction in each case. For example, in a three-catalyst bed system, the first bed will generally contain from about 10 to about 30 vol. %; the second, from about 25 to about 45 vol. %; and the third, from about 40 to about 60 vol. %, all percentages being based on the amount of catalyst within the reaction zone. With respect to a four-catalyst bed system, suitable catalyst loadings would be from about 5 to about 15 vol. % in the first bed, from about 15 to about 25 vol. % in the second, from about 25 to about 35 vol. % in the third, and from about 35 to about 50 vol. % in the fourth. The reactant stream, comprising hydrogen and the hydrocarbon feed, should desirably flow serially through the reaction zones in order of increasing catalyst volume and interstage heating. The unequal catalyst distribution, increasing in the serial direction of reactant stream flow, facilitates and enhances the distribution of the reactions.

Continuous regenerative reforming systems offer numerous advantages when compared to the fixed bed systems. Among these is the capability of efficient operation at comparatively lower pressures, e.g., 20 to about 200 psig, and higher liquid hourly space velocities, e.g., about 3 to about 10 $hr.^{-1}$. As a result of continuous catalyst regeneration, higher consistent inlet catalyst bed temperatures can be maintained, e.g., 950° to about 1010° F. Furthermore, there is afforded a corresponding increase in hydrogen production and hydrogen purity in the hydrogen-containing vaporous phase from the product separation facility.

Upon removal of the hydrocarbon and hydrogen effluent from the catalytic reaction zone, it is customarily subjected to indirect heat exchange typically with the hydrogen and hydrocarbon feed to the catalytic reaction zone. Such an indirect heat exchange aids in the further processing of the reaction zone effluent by cooling it and recovers heat which would otherwise be lost for further use in the catalytic reforming process. Following any such cooling step, which may be employed, the reaction zone effluent is passed to a vapor-liquid equilibrium separation zone to recover a hydrogen-containing vapor phase from the effluent, at least a portion of which is to be recycled back to the reforming zone. The vapor-liquid equilibrium separation zone is usually-maintained at substantially the same pressure as employed in the reforming reaction zone, allowing for the pressure drop in the system. The temperature within the vapor-liquid equilibrium separation zone is typically maintained at about 60° to about 120° F. The temperature and pressure are selected in order to produce a hydrogen-containing vapor phase and a principally liquid phase comprising unstabilized reformate.

As noted previously, the catalytic reforming process generally requires the presence of hydrogen within the reaction zone. Although this hydrogen may come from any suitable source, it has become the common practice to recycle a portion of the hydrogen-containing vapor phase derived from the vapor-liquid equilibrium separation zone to provide at least part of the hydrogen required to assure proper functioning of the catalytic reforming process. The balance of the hydrogen-containing vapor phase is therefore available for use elsewhere. As noted above, a principally liquid phase comprising unstabilized reformate is withdrawn from the first vapor-liquid equilibrium separation zone. Pursuant to the invention, a portion of this unstabilized liquid reformate comprising from about 20 to 75 vol. % of the total reformate is passed to a heat exchange means for indirect heat exchange with a hereinafter defined second unstabilized liquid reformate. Heat exchange of the hydrogen-containing vapor phase with the hydrogen-rich vapor phase pre-cools the hydrogen-containing vapor phase before it is chilled and passed to an absorption zone. The heat exchange will typically lower the temperature of the hydrogen-containing vapor phase to a temperature of 20° to 60° F. and the refrigeration will further lower its temperature to 15° to 20° F. Similarly heat exchange of the liquid hydrocarbon stream from the first separator with the liquid product stream pre-cools the liquid hydrocarbons stream that is chilled in a separate refrigeration zone and passed to the absorption zone. The heat exchange lowers the temperature of the cooled liquid product stream to a temperature of 20° to 60° F. The refrigeration lowers the temperature of the liquid stream to a temperature of between 20° to −20° F.

The chilled liquid stream passes downwardly through an absorption zone and therein countercurently contacts the chilled hydrogen-containing gas stream as it rises upwardly through the absorption zone.

The absorption zone is of an ordinary design and typically arranged as a vertical column with internals for promoting liquid to vapor contact. Suitable internals for liquid vapor contact comprise trays or packing. Operating pressure for the column will usually be in a range of from 50 to 500 psig. Preferably the column is operated so that the vapor stream enters and leaves the column at the same temperature. Therefore, in order to overcome the heat generated by absorption, the liquid stream entering the top of the column will usually have a temperature of about 5° to 15° F. lower than the temperature of the vapor stream. The contacting conditions within the absorption column are set to recover a hydrogen-rich stream of medium purity from the absorption column. For the purposes of this invention medium purity will usually mean a purity of 85 to 95 mol % hydrogen.

By the use of this invention, it has been determined that the overall addition of the liquified reformate stream to the absorption zone can be kept in the range of from 20 to 75 vol. % of the unstabilized liquid reformate and preferably in a range of 25 to 50 vol. %. In relation to the hydrocarbon vapor, the molar ratio of the first liquid phase passing in indirect heat exchange to the hydrocarbon vapor is about 0.25 to 0.60.

The vapor stream from the absorption zone provides substantial cooling to the hydrogen-containing vapor stream that enters the adsorption zone. Cooling of the liquid reformate stream that enters the adsorption zone is provided by the liquid bottoms stream from the adsorption zone.

As will readily be recognized by the practitioner, upon pre-cooling, a small portion of the hydrogen-containing vapor phase may condense; however, it is to be understood that the term "hydrogen-containing vapor phase" as used herein is intended to include that small condensed portion. Hence, the entire hydrogen-containing vapor phase including any portion thereof condensed upon pre-cooling is admixed with the unstabilized liquid reformate.

In accordance with the present invention the hydrogen-containing vapor phase is subjected to refrigeration. Although not typically necessary for catalytic reforming, it may be necessary to assure that these hydrogen vapor phase streams are sufficiently dry prior to refrigeration. Drying of the hydrogen-containing vapor phase may be necessary because water, intentionally injected into the reaction zone or comprising a reaction zone feed contaminant, must be substantially removed to avoid formation of ice upon refrigeration. By drying the hydrogen-containing vapor phase, formation of ice and the resulting reduction of heat transfer coefficients in the heat exchanger of the refrigeration unit utilized to effect the cooling are avoided. It is also to avoid freezing that the temperature of the liquid stream entering the absorption zone may be reduced relative to the temperature of the hydrogen containing stream.

If drying is required, it may be effected by any means known in the art. Absorption using liquid desiccants such as ethylene glycol, diethylene glycol, and triethylene glycol may be advantageously employed. In such an absorption system, a glycol desiccant is contacted with the hydrogen-containing vapor phase in an absorber column. Water-rich glycol is then removed from the absorber and passed to a regenerator wherein the water is removed from the glycol desiccant by application of heat. The resulting lean glycol desiccant is then recycled to the absorber column for further use. As an alternative to absorption using liquid desiccants, drying may also be effected by adsorption utilizing a solid desiccant. Alumina, silica gel, silica-alumina beads, and molecular sieves are typical of the solid desiccants which may be employed. Generally, the solid desiccant will be placed in at least two beds in a parallel flow configuration. While the hydrogen-containing vapor phase is passed through one bed of desiccant, the remaining bed or beds are regenerated. Regeneration is generally effected by heating to remove desorbed water and purging the desorbed water vapor from the desiccant bed. The beds of desiccant may, therefore, be cyclically alternated between drying and regeneration to provide continuous removal of water from the hydrogen-containing vapor phase.

In regard to refrigeration, any suitable refrigeration means may be employed. For example, a simple cycle comprising a refrigerant evaporator, compressor, condenser, and expansion valve or if desired, a more complex cascade system may be employed. The exact nature and configuration of the refrigeration scheme is dependent on the desired temperature of the refrigerated admixture and in turn that temperature is dependent on the composition of the admixture and the desired hydrogen purity of the hydrogen-rich gas. Preferably, the temperature should be as low as possible with some margin of safety to prevent freezing. Generally, the refrigeration temperature will be from about −15° to 42° F. In addition, it should be noted that the exact desired temperature of the refrigerated admixture will determine whether drying of the hydrogen-containing vapor phase is necessary in order to avoid ice formation within the refrigeration heat exchanger and the concomitant reduction in heat transfer coefficient accompanied therewith. For catalytic reforming, a temperature of about 0° F. is usually suitable without the necessity of drying the hydrogen-containing vapor phase. This is because the water content of the hydrogen-containing vapor phase is about 20 mole ppm.

The reformate withdrawn from the absorption zone will differ from the first unstabilized liquid reformate in that the second will contain more $C_1+$ material transferred from the hydrogen-containing vapor phase. The unstabilized reformate withdrawn from the absorption zone may be passed to a fractionation zone after being subjected to indirect heat exchange in accordance with the invention. By subjecting the second unstabilized reformate to indirect heat exchange, it is thereby preheated prior to its passage to the fractionation zone. The indirect heat exchange step therefore results in supplementary energy savings by avoiding the necessity of heating the unstabilized reformate from the temperature at which the absorption zone is maintained prior to fractionation and also by reducing the refrigeration requirement of the system.

The hydrogen-rich gas stream withdrawn from the absorption zone will preferably have, depending on the conditions therein, a hydrogen purity in excess of 90 mol. %. After subjecting the hydrogen-rich gas stream to indirect heat exchange pursuant to the invention, the hydrogen-rich gas stream may then be passed to other hydrogen-consuming processes or may be utilized in any suitable fashion. It should be noted that by subjecting the hydrogen-rich gas stream to indirect heat exchange with the hydrogen-containing vapor phase, there accrues certain supplementary energy savings. Typically, the hydrogen-rich gas stream must undergo heating before it can be used in a hydrogen-consuming process. Accordingly, by subjecting the hydrogen-rich gas to indirect heat exchange and thereby warming it, energy savings will be achieved, avoiding the necessity of heating the hydrogen-rich gas stream from the temperature maintained in the absorption zone. Additionally, such a heat exchange step decreases the total refrigeration requirements further reducing the energy requirements of the system.

To more fully demonstrate the attendant advantages of the present invention, the following examples, based on thermodynamic analysis, engineering calculations, and estimates are set forth. Details such as miscellaneous pumps, heaters, coolers, valving, start-up lines, and similar hardware have been omitted as being nonessential to a clear understanding of the techniques involved.

DETAILED DESCRIPTION OF THE DRAWINGS

Specifically referring to FIG. 1, a naphtha boiling range hydrocarbon charge stock is introduced via line 1 and mixed with a hydrogen-containing vapor phase recycled via line 13. The admixture is then passed through line 1 to combined feed exchanger 2 wherein the hydrogen and hydrocarbon charge are subjected to indirect heat exchange with the hydrogen and hydrocarbon effluent from the catalytic reforming reaction zone. The preheated hydrogen and hydrocarbon charge mixture is then withdrawn from the combined feed exchanger 2 via line 3. It is then passed into charge heater 4 wherein the hydrogen and hydrocarbon charge stock are heated to a reaction zone temperature of about 1000° F.

After being heated in charge heater 4, the hydrogen and hydrocarbon charge stock are passed via line 5 into catalytic reforming reaction zone 6 and contacted with a reforming catalyst comprising platinum. The effluent therefrom comprising hydrogen and hydrocarbons is withdrawn from reaction zone 6 via line 7 and passed to combined feed exchanger 2. As noted above, the hydrogen and hydrocarbon effluent from reaction zone 6 is subjected to indirect heat exchange with the hydrogen and hydrocarbon feed in line 1. As a result of this heat exchange, the temperature of the reaction zone effluent is lowered from about 1020° F. to about 200° F. In addition, although not depicted in the present drawing, the temperature of the reaction zone effluent is further reduced to about 100° F. or less by subjecting it to indirect heat exchange with ambient air and/or cooling water.

The reaction zone effluent is passed via line 8 to first vapor-liquid equilibrium separation zone 9 to produce a first hydrogen-containing vapor phase comprising 75 to 85 mol. % hydrogen and a first unstabilized liquid reformate. The first vapor-liquid separation zone operates at a temperature of about 100° F. and a pressure of about 50 to 500 psig. The hydrogen-containing vapor phase is withdrawn from vapor-liquid equilibrium separation zone 9 via line 11. In order to satisfy the hydrogen requirements of the catalytic reforming reaction zone, a first portion of the hydrogen-containing vapor phase is passed via line 11 to recycle compressor 12. The first portion of the hydrogen-containing vapor phase is then passed via line 13 for admixture with the naphtha boiling range charge stock in line 1. A second portion of the hydrogen-containing vapor phase comprising the balance thereof is diverted through line 14. The composition of vapor in line 11 is shown in Table 1. The first unstabilized liquid reformate phase is withdrawn from vapor-liquid equilibrium separation zone 9 via line 10. A portion comprising about 20 to 40 vol. % of the total unstabilized liquid reformate is diverted via line 19. The balance of the unstabilized liquid reformate is continued through line 10 and passed to fractionation facilities not depicted herein.

The second hydrogen-containing vapor phase from line 14 may be compressed as necessary to raise its pressure to the range of 50 to 500 psig. After any compression, the second hydrogen-containing vapor phase is passed via line 14 to pre-cooling heat exchanger 17. In pre-cooling heat exchanger 17, the second portion of the hydrogen-containing vapor phase is subjected to indirect heat exchange with a hydrogen-rich gas stream. This heat exchange step reduces the temperature of the hydrogen-containing vapor phase from about 100° to about 50° F. The pre-cooled portion of the hydrogen-containing vapor phase is then withdrawn from pre-cooling heat exchanger 17 via line 18. A 10 to 20 vol. % portion of the unstabilized liquid reformate is passed via line 19 to pre-cooling heat exchanger 20 and indirectly heat exchanged with an unstabilized liquid reformate stream which reduces the temperature of the unstabilized liquid reformate from about 100° to about 30° F. The pre-cooled unstabilized liquid reformate is withdrawn from pre-cooling heat exchanger 20 via line 21 and admixed with the second portion of the hydrogen-containing vapor phase in line 18.

The resulting admixture which is at a temperature of about 20° to 60° F. is passed via line 22 to refrigeration means 23 which has been depicted as a simple box for convenience. The admixture is withdrawn from refrigeration zone 23 at a temperature of −15° to 15° F. via line 24 and is thereafter passed to second vapor-liquid equilibrium separation zone 25 which is maintained at a temperature of about −15° to 15° F. and a pressure of about 50 to 500 psig.

The hydrogen-rich gas stream withdrawn from second vapor-liquid equilibrium separation zone 25 via line 26 is passed to pre-cooling heat exchanger 17 and indirectly heat exchanged with the hydrogen-containing vapor phase. The temperature of the hydrogen-rich gas stream is increased from about 0° to 80° F. as a result of the heat exchange step. The hydrogen-rich gas stream is then withdrawn from pre-cooling heat exchanger 17 via line 27 and passed on for further use in other process units not herein depicted.

The unstabilized liquid reformate withdrawn from vapor-liquid equilibrium separation zone 25 via line 28 is passed to pre-cooling heat exchanger 20 and indirectly heat exchanged with the first unstabilized liquid reformate from line 19. The temperature of the second unstabilized liquid reformate is increased from about 0° to about 60° F. The unstabilized liquid reformate is then withdrawn from pre-cooling heat exchanger 20 via line 29. It is thereafter passed to fractionation facilities not herein depicted.

The recovery of vapor and liquid components from lines 27 and 29 of the prior art arrangement shown in FIG. 1 is listed in Table 1.

Figure 2:
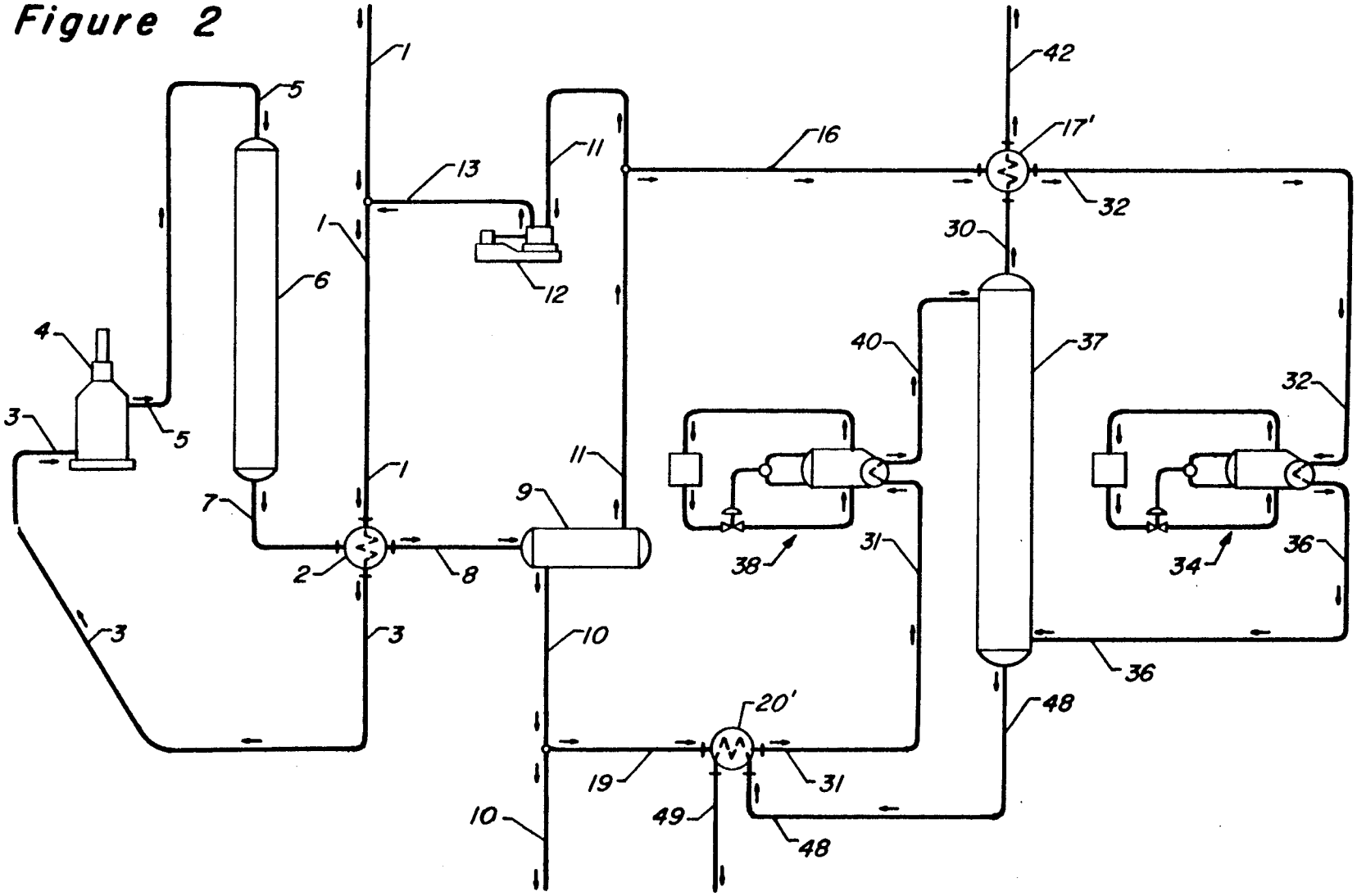
FIG. 2 shows a reforming process with a system for recovering a hydrogen-rich gas product and a reformate liquid product arranged in accordance with this invention.

FIG. 2 shows an arrangement for the process of this invention that is used to process an identical feedstream to that used when describing the prior art process depicted in FIG. 1. The reforming section and the initial separation of the effluent from the reforming zone is identical to that described in the flowscheme of FIG. 1. Therefore, the same reference numerals have been used to indicate the common elements and the description in the context of FIG. 1 applies thereto and will not be repeated.

The hydrogen-containing gas stream having the composition listed in Table 1 is again diverted in part by a line 16. The hydrogen containing gas of line 16 is carried through a pre-cooling heat exchanger 17' where it is heat exchanged against the hydrogen-rich gas stream carried by a line 30. Passing the hydrogen-containing gas stream through pre-cooler 17' cools the gas stream from a temperature of about 100° to a temperature of 50° F. From exchanger 17' a line 32 transfers the cooled hydrogen containing gas stream to refrigeration zone 34. Refrigeration zone 34 chills the hydrogen containing gas stream to a temperature of 0° F. and a line 36 passes the chilled hydrogen containing gas to the bottom of a trayed adsorption column 37.

The portion of the unstabilized liquid reformate stream carried by line 19 passes through a pre-cooling heat exchanger 20' where it is cooled from a temperature of about 100° to a temperature of 30° F. by heat exchange against liquid reformate stream 48. Line 31 carries the liquid reformate from the pre-cooling heat exchanger 20' to a refrigeration zone 38. Refrigeration zone 38 chill the liquid reformate to a temperature of −10° F. and a line 40 passes the chilled reformate to the top of absorption zone 37.

Absorption of light hydrocarbons from the hydrogen containing stream in the absorption zone provides a hydrogen-rich gas stream having a hydrogen purity of greater than 90 mol % that is recovered from the top of absorption column 37 by line 30. Heat exchange of the hydrogen-rich gas stream in line 30 through pre-cooler 17' raises its temperature from 0° F. to 80° F. The heated hydrogen-rich gas stream is recovered from heat exchanger 17' by a line 42 as a hydrogen-rich gas product and has the composition listed in Table 1.

Additional unstabilized liquid reformate is withdrawn from the bottom of absorption column 37 by a line 48. Heat exchange in pre-cooler 20' raises the temperature of the combined liquid reformate of line 48 from 0° F. to 60° F. The cooled combined liquid reformate stream is recovered by a line 49 and provides the recovery of liquid product listed in Table 1.

A comparison of the product recoveries for the prior art flow arrangement of FIG. 1 and the flow arrangement of this invention in FIG. 2 shows the unexpected results that have been obtained by the novel flow arrangement of this invention. The replacement of the separator with an absorption column and the addition of an extra chiller was found to more than double the liquid recovery of propane from the hydrogen-containing gas stream. In the prior art example of FIG. 1, the liquid recovery of propane was 29.1% giving a total recovery of 194 barrels per day. By the use of the absorption column and the additional chiller, the percent liquid recovery of propane rose to 63.2% and provided an additional 228 barrels per day of liquid propane. In addition to the greatly increased propane recovery, there were also significant increases in the recovery of butane. The average percent liquid recovery of butane in the prior art arrangement is approximately 60% and provides a total butane liquid recovery of 227 barrels per day. The recovery arrangement of the instant invention provided an average butane liquid recovery of 80% for an additional liquid recovery of 71 barrels per day, or an increase of 30%.

TABLE 1

| | | PRIOR ART (FIG. 1) | | | ARRANGEMENT OF FIG. 2 | | |
|---|---|---|---|---|---|---|---|
| | lb mol/hr Vapor In | lb mol/hr Vapor Out (Line 27) | % liquid Recovery (Line 29) | BPD Liq Recovery (Line 29) | lb mol/hr Vapor Out (Line 42) | % liquid Recovery (Line 49) | BPD Liq Recovery (Line 49) |
| Hydrogen | 5496.96 | 5494.01 | — | — | 5496.13 | — | — |
| Methane | 244.84 | 242.59 | — | — | 239.49 | — | — |
| Ethane | 189.31 | 176.52 | — | — | 155.23 | — | — |
| Propane | 112.01 | 79.38 | 29.1 | 194 | 41.18 | 63.2 | 422 |
| i Butane | 24.65 | 10.94 | 55.6 | 97 | 5.30 | 78.5 | 137 |
| n Butane | 28.90 | 9.82 | 66.0 | 130 | 5.26 | 81.8 | 161 |
| i Pentane | 13.09 | 2.18 | 83.4 | 86 | 1.74 | 86.7 | 90 |
| n Pentane | 6.89 | 0.89 | 87.1 | 47 | 0.81 | 88.3 | 48 |
| Hexane+ | 33.34 | 2.08 | 93.8 | 268 | 2.65 | 92.0 | 263 |
| Total | 6147.95 | 6018.39 | — | 822 | 5947.77 | — | 1120 |

What is claimed is:

1. A process for producing a hydrogen-rich gas stream by treating a hydrogen and hydrocarbon effluent from a catalytic hydrocarbon conversion reaction zone comprising the steps of:

(a) passing at least a portion of said effluent to a first vapor-liquid separation zone and recovering therefrom a hydrogen-containing vapor phase and a first liquid phase comprising hydrocarbon;

(b) passing at least a portion of the hydrogen-containing vapor phase in indirect heat exchange with a hydrogen-rich gas stream;

(c) refrigerating the heat-exchanged hydrogen-containing vapor phase;

(d) passing only a portion of the first liquid phase comprising about 20 to 75 vol. % of the total first liquid phase in indirect heat exchange with a second liquid phase;

(e) refrigerating the heat-exchanged first liquid;

(f) passing the refrigerated hydrogen-containing vapor phase and the refrigerated first liquid at a temperature of from −20° to 20° F. to an absorption zone and countercurrently contacting said vapor phase with said first liquid in said absorption zone to absorb hydrocarbons from said vapor phase;

(g) withdrawing said second liquid phase from said absorption zone; and (h) withdrawing said hydrogen-rich gas stream from said absorption zone and recovering said hydrogen rich gas stream after the heat exchange of step (b).

2. A process for producing a hydrogen-rich gas stream by treating a hydrogen and hydrocarbon effluent from a catalytic hydrocarbon conversion reaction zone comprising the steps of:

(a) passing at least a portion of said effluent to a first vapor-liquid separation zone and recovering therefrom a hydrogen-containing vapor phase and a first liquid phase comprising hydrocarbon;

(b) passing at least a portion of the hydrogen-containing vapor phase in indirect heat exchange with a hydrogen-rich gas stream;

(c) refrigerating the heat-exchanged hydrogen-containing vapor phase;

(d) passing only a portion of the first liquid phase comprising about 20 to 75 vol. % of the total first liquid phase in indirect heat exchange with a second liquid phase;

(e) refrigerating the heat-exchanged first liquid;

(f) passing the refrigerated hydrogen-containing vapor phase and the refrigerated first liquid separately to an absorption zone and countercurrently contacting said vapor phase with said first liquid in said absorption zone to absorb hydrocarbons from said vapor phase wherein the refrigerated hydrogen-containing vapor phase enters said absorption zone at a temperature of from −15° to 20° F. and at a higher temperature than said first liquid;

(g) withdrawing said second liquid phase from said absorption zone; and (h) withdrawing said hydrogen-rich gas stream from said absorption zone and recovering said hydrogen rich gas stream after the heat exchange of step (b).

* * * * *